US011958651B1

(12) United States Patent
Gonzalez

(10) Patent No.: US 11,958,651 B1
(45) Date of Patent: Apr. 16, 2024

(54) DEVICE FOR FILLING CONTAINERS

(71) Applicant: Astronaut Ideas Inc, Chicago, IL (US)

(72) Inventor: Cesar D. Gonzalez, Chicago, IL (US)

( * ) Notice: Subject to any disclaimer, the term of this patent is extended or adjusted under 35 U.S.C. 154(b) by 150 days.

(21) Appl. No.: 17/586,227

(22) Filed: Jan. 27, 2022

(51) Int. Cl.

| | |
|---|---|
| ***B65B 67/02*** | (2006.01) |
| ***B65B 1/06*** | (2006.01) |
| ***B65B 1/36*** | (2006.01) |
| ***B65B 3/06*** | (2006.01) |
| ***B65B 3/30*** | (2006.01) |
| ***B65B 39/00*** | (2006.01) |
| ***B65B 39/06*** | (2006.01) |
| ***B65B 43/54*** | (2006.01) |
| ***B65B 59/00*** | (2006.01) |

(52) U.S. Cl.
CPC ..... *B65B 67/02* (2013.01); *B65B 1/06* (2013.01); *B65B 1/36* (2013.01); *B65B 3/06* (2013.01); *B65B 3/30* (2013.01); *B65B 39/007* (2013.01); *B65B 39/06* (2013.01); *B65B 43/54* (2013.01); *B65B 59/003* (2019.05)

(58) Field of Classification Search
CPC .... B65B 1/04; B65B 1/06; B65B 1/36; B65B 3/04; B65B 3/06; B65B 3/30; B65B 39/007; B65B 39/06; B65B 43/54; B65B 59/003; B65B 67/00; B65B 67/02
See application file for complete search history.

(56) References Cited

U.S. PATENT DOCUMENTS 1,790,626 A * 1/1931 Menninger ..... B65B 39/00 141/237
2,027,830 A * 1/1936 Krein ..... B65B 39/00 141/237
2,720,351 A * 10/1955 Fleischer ..... A61J 3/075 141/246
3,566,929 A * 3/1971 Mead ..... B65B 39/06 141/237
3,664,387 A * 5/1972 Cates, Jr. ..... B65B 3/30 141/238
3,693,673 A * 9/1972 Oates ..... B65B 39/00 141/237
3,732,903 A * 5/1973 Oates ..... B67C 11/02 141/237
4,827,827 A * 5/1989 Sanfilippo ..... F42B 33/0292 222/572
5,139,059 A * 8/1992 Dierkes ..... A23G 3/2023 141/237
5,813,444 A * 9/1998 Cashion ..... B65B 1/06 141/237
7,308,919 B1 * 12/2007 Zavala ..... B65B 39/00 141/238

(Continued)

*Primary Examiner* — Nicolas A Arnett
(74) *Attorney, Agent, or Firm* — Brie A. Crawford; Crawford Intellectual Property Law LLC

(57) ABSTRACT

A device for filling containers has a top tray that engages with a bottom tray to fill containers. The bottom tray has a plurality of receiving slots to hold the containers and the top tray has a series of sleeves to insert into the containers for filling. An optional side tray collects excess food for later use or disposal. A method of using the device has the containers being secured by a plurality of receiving slots on the bottom tray, the plurality of sleeves on the top tray inserting into the plurality of containers, and food transferred or poured onto the top surface of the top tray, travelling through top openings on each of the plurality of sleeves to the containers.

5 Claims, 3 Drawing Sheets

(56) References Cited

U.S. PATENT DOCUMENTS

| | | | | |
|---|---|---|---|---|
| 8,684,045 | B1 * | 4/2014 | Moehle | B65B 67/12 248/101 |
| 10,604,292 | B1 * | 3/2020 | Dodson | B65B 39/00 |
| 11,027,958 | B2 * | 6/2021 | Kalina | B67C 11/02 |
| D957,680 | S * | 7/2022 | Evans | B01L 3/50853 D24/224 |
| 2001/0043972 | A1 * | 11/2001 | Tomlinson | B65B 1/06 426/115 |

* cited by examiner

DEVICE FOR FILLING CONTAINERS

This invention relates to a device for filling containers and more particularly, this invention relates to a device for filling a plurality of containers that has a top tray that cooperates with a bottom tray to fill the containers. This invention also relates to a method for using the device for filling containers.

BACKGROUND OF THE INVENTION

In the restaurant and food industry, many liquid and semi-solid foods are served in individual containers such as, but not limited to, sauces, salsas, condiments, and jellies (hereinafter "food" and "food" encompasses all foods, in any form, that can be used by the device for filling containers of this invention). These individual containers are convenient for creating individual or smaller servings to dispense to multiple tables, placing in to-go orders, or selling for home use. However, filling the individual containers can be time consuming and cumbersome. A device that can make filling individual food containers quicker, easier, and more convenient will be a useful invention.

Moreover, when filling individual containers with food, the containers must be filled enough to provide an adequate amount of food, yet not overfilled which can lead to spilling and waste of food and also create a mess. Also, the containers may need to be covered with a lid when filled and cannot be filled too full as to prevent a lid being placed on top. A device that can fill individual food containers while preventing overfilling will be a useful invention.

Also, when filling individual containers with food, excess food may be poured or spilled and this can lead to the excess food being wasted. Wasted food can affect the bottom line of the restaurant or food establishment and can be harmful to the environment. A device that reduces the amount of wasted food when filling containers with food will be a useful invention.

SUMMARY OF THE INVENTION

An objective of the present invention is the provision of a device for filling containers that can accommodate a plurality of containers to be filled.

Another objective of the present invention is the provision of a device for filling containers that can fill containers with food while not overfilling the containers.

A further objective of the present invention is the provision of a device for filling containers that reduces the amount of food waste by allowing excess food to be transferred and placed back into the original container.

A still further objective of the present invention is the provision of a device for filling containers that makes it more convenient and less time consuming to fill individual containers with food.

A method for using a device for filling containers is also disclosed.

Other objectives and advantages of the invention will become apparent from the description of the preferred embodiments herein.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
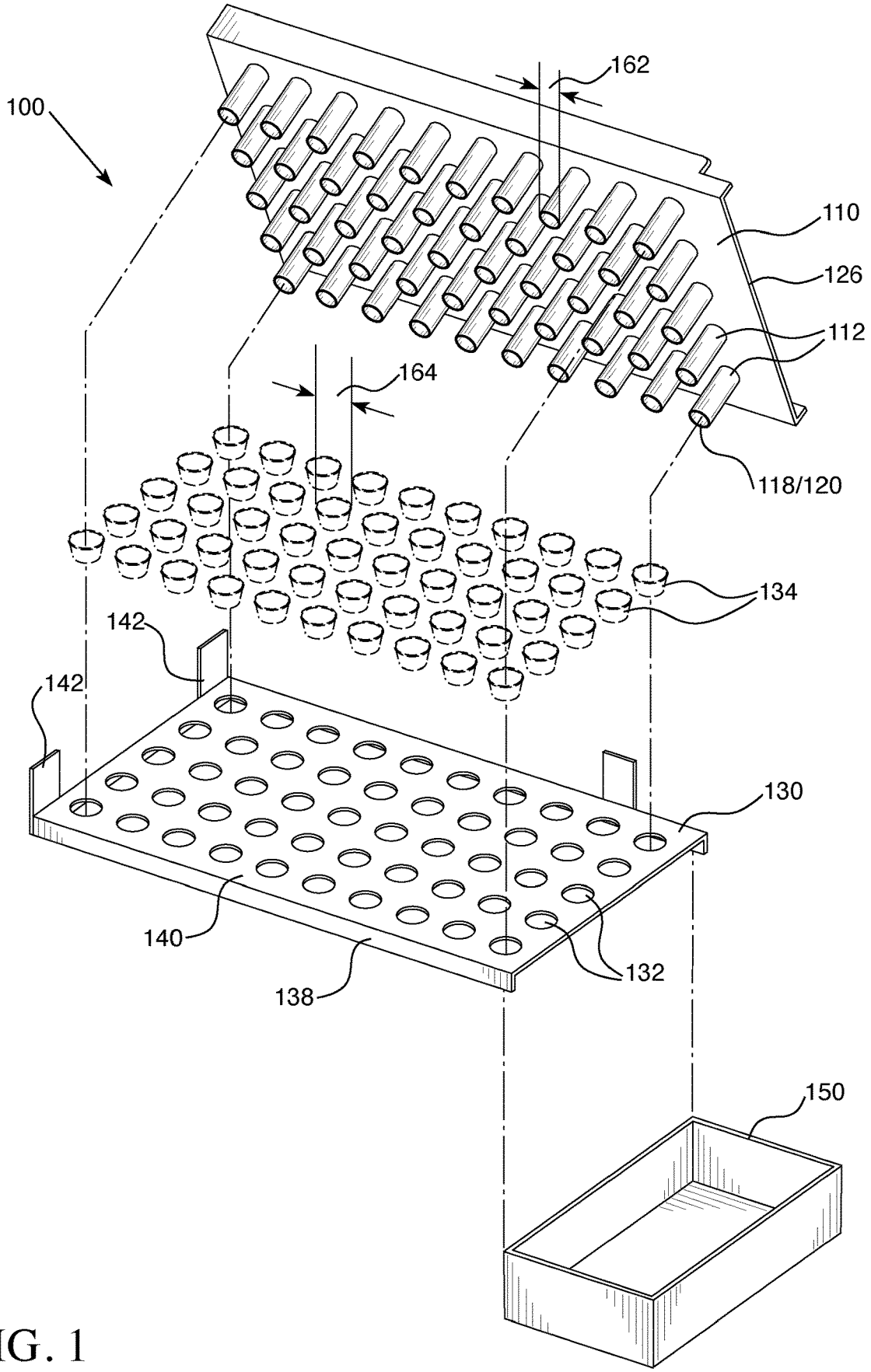
FIG. 1 depicts an exploded perspective view of a device for filling containers 100 with containers 134 depicted in phantom.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

Figure 2:
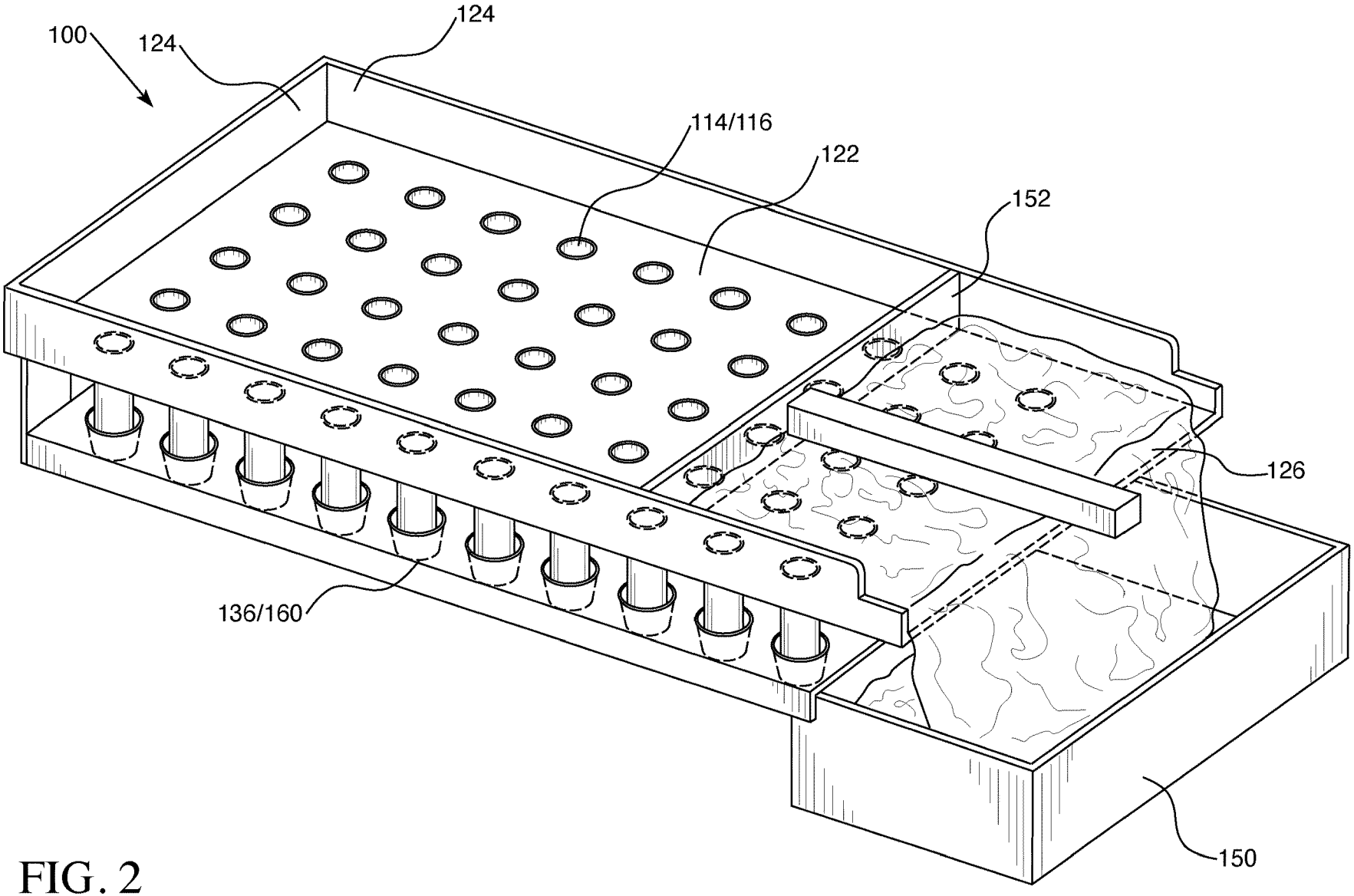
FIG. 2 depicts a top perspective view of a device for filling containers 100 with tool 152 scraping food into side tray 150 with containers 134 depicted in phantom.

Now adding FIG. 1 and FIG. 2 to the consideration, device for filling containers 100 (hereinafter "device 100) can be clearly seen. Device 100 has top tray 110, bottom tray 130, and optional side tray 150.

Top tray 110 has a plurality of sleeves 112 extending downwardly from a top surface 122. Each sleeve 112 has a top opening 114 at top end 116 and a bottom opening 118 at bottom end 120. Top tray 110 also has one or more side walls 124. Side walls 124 help contain food within the top surface 122 of top tray 110 so the food does not spill. Top tray 110 may have open end 126 without a side wall 124 so that food may be scraped and transferred into side tray 150.

Bottom tray 130 has a plurality of receiving slots 132 which receive containers 134. Bottom tray 130 also has one or more legs 138 to lift the top surface 140 off of the table or other surface device 100 is placed on to provide clearance between the containers 134 when resting in receiving slots 132 and the table or other surface.

Bottom tray 130 has one or more posts 142. Posts 142 help guide the placement of top tray 110 onto bottom tray 130 and guide the placement of sleeves 112 into containers 134. Posts 142 also help to support the top tray 110 on bottom tray 130 after placement.

A user places containers 134 in receiving slots 132 with each receiving slot 132 being able to receive one container 134. Then, top tray 110 is placed on top of bottom tray 130 so that the bottom ends 120 of sleeves 112 insert into a corresponding container 134. Top tray 110 rests on bottom tray 130 in this position.

The user can then pour food onto the top surface 122 of top tray 110. The food enters a top opening 114 of a sleeve 112, travels down sleeve 112, and exits through bottom opening 118 into a container 134. Food may enter top opening 114 on its own, the user may tilt the top tray 110/bottom tray 130 combination, or the user may use tool 152 to direct the food into top openings 114.

Once all of the containers 134 are filled, the user may transfer the remaining food on the top tray 110 to a side tray 150. The food may be directed to side tray 150 by tilting the top tray 110/bottom tray 130 combination so that it is positioned in a downward slope toward side tray 150. Or, the user may use tool 152 to direct the food to side tray 150. The food in side tray 150 may be placed back in the original food container or otherwise disposed. If the food is placed in the original food container, it may be used to fill future containers 134.

In the depicted embodiment, tool 152 is a scraper, but any suitable tool 152 can be used and is encompassed by this disclosure. Other tools 152 include, but are not limited to, a spoon, spatula, or other flat kitchen tools that are commercially available.

In the preferred embodiment, each sleeve 112 extends to the bottom 136 of the container 134 to create a seal 160. The creation of the seal 160 prevents food from leaving each sleeve 112 during filling and until top tray 110 is lifted and disengaged from bottom tray 130. Thus, when the level of the food is level with the top opening 114, filling stops and this prevents container 134 from being overfilled.

Also, it is preferred that the diameter 162 of each sleeve 112 is 65 to 85 percent of the diameter 164 of each container 134. This difference in diameter allows for each container 134 to be filled between 65 to 85 percent capacity. When the food is even with the top opening 114, filling stops and the diameter difference allows the containers 134 to be filled to 65 to 85 percent capacity. If the containers 134 are filled to 65 to 85 percent capacity, there is still room to shake, mix, or stir food and also leaves room to prevent over-spill when installing an optional cap or lid on container 134.

Figure 3:
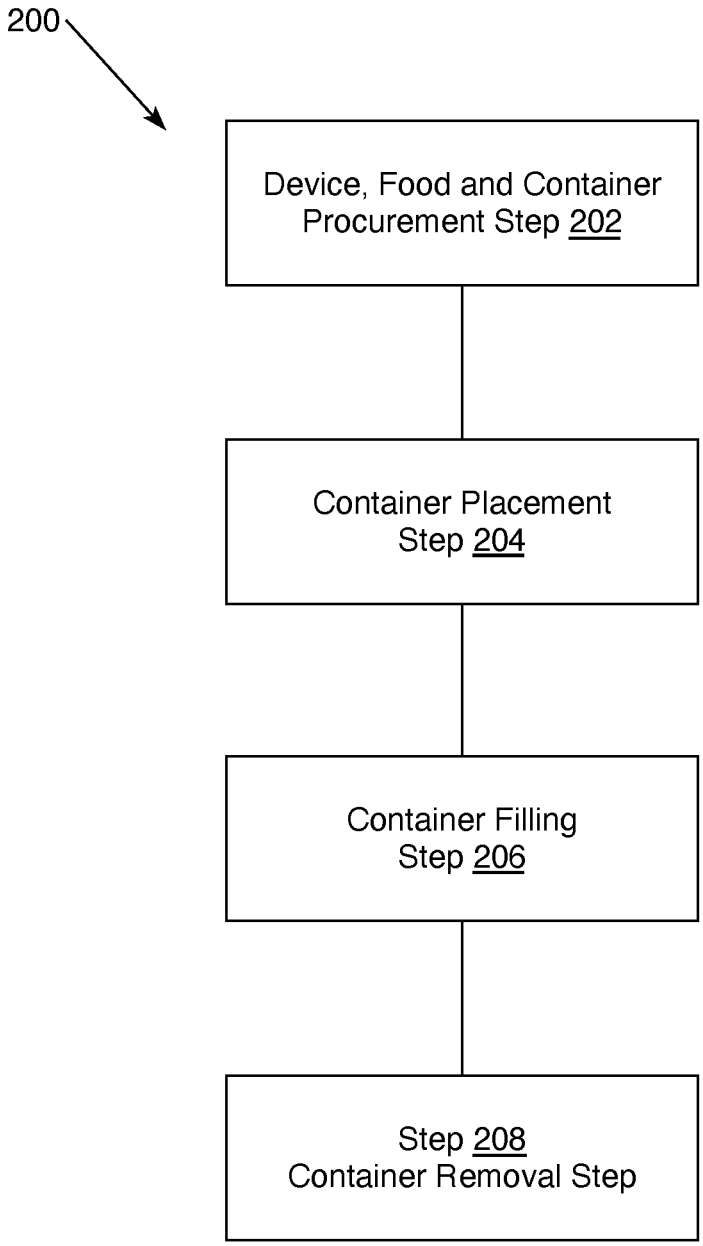
FIG. 3 depicts a block diagram of method 200 of this invention.

Now adding FIG. 3 to the consideration, method 200 can be clearly seen. Method 200 has the following steps. As will be obvious to persons of ordinary skill in the art, the steps, or steps equivalent thereto, may be practiced in any reasonable order which will produce the desired result.

STEP 202 is the device, food, and container procurement step. In this STEP 202, a device 100, food, a plurality of containers 134, optional side tray 150, and optional tool 152 are obtained. Any or all of device 100, containers 134, optional side tray 150, and optional tool 152 may be procured before the need to place food in the containers 134 and may not need to be obtained again.

STEP 204 is the container placement step. In this STEP 204, containers 134 are placed in receiving slots 132 of bottom tray 130. Then, top tray 110 is placed on top of bottom tray 130 with each sleeve 112 placed in a corresponding container 134.

STEP 206 is the container filling step. In this STEP 206, food is poured or placed on a top surface 122 of top tray 110. Food is then transferred to containers 134 through top openings 114. Food either naturally travels to top openings 114, the top tray 110/bottom tray 130 combination is tilted to allow food to travel to top openings 114, or a tool 152 is used to transfer food to top openings 114.

Optionally, any excess food may be transferred to optional side tray 150. Food may be transferred from the top tray 110/bottom tray 130 combination to side tray 150 by tilting top tray 110/bottom tray 130 or using an optional tool 152.

STEP 208 is the container removal step. In this STEP 208, the top tray 110 is removed from engagement with bottom tray 130. Containers 134 are removed from bottom tray 130. An optional lid may be placed on containers 134 either before or after they are removed from bottom tray 130.

STEPS 202 to 208 may be repeated as many times as necessary to fill as many containers 134 as desired.

While various embodiments and aspects of the present invention have been described above, it should be understood that they have been presented by way of example only, and not limitation. Thus, the breadth and scope of the present invention should not be limited by any of the above exemplary embodiments.

This application—taken as a whole with the abstract, specification, claims, and drawings being combined—provides sufficient information for a person having ordinary skill in the art to practice the invention as disclosed herein. Any measures necessary to practice this invention are well within the skill of a person having ordinary skill in this art after that person has made a careful study of this disclosure.

Because of this disclosure and solely because of this disclosure, modification of this device can become clear to a person having ordinary skill in this particular art. Such modifications are clearly covered by this disclosure.

The invention claimed is:

1. A device for filling containers comprising:

a) the device having a top tray and a bottom tray, wherein the top tray is configured to rest on the bottom tray;

b) the top tray having a plurality of sleeves;

c) the bottom tray having a plurality of receiving slots, wherein each of the plurality of receiving slots are configured to receive a container, further wherein each of the plurality of sleeves are configured to insert into the container received by the cooperating receiving slot;

d) the top tray having a plurality of sidewalls and an open end, wherein the open end is configured to cooperate with a side tray;

e) the bottom tray having a plurality of legs;

f) each of the plurality of sleeves having a top opening at a top end and a bottom opening at a bottom end; and g) the bottom end of each of the plurality of sleeves contacting the bottom of the container when the top tray is placed on the bottom tray, further wherein a seal is formed between the bottom of the container and the corresponding sleeve.

2. The device for filling containers of claim 1 further comprising:

a) a diameter of each of the plurality of sleeves being between 65 and 85 percent of a diameter of the container in the cooperating receiving slot.

3. The device for filling containers of claim 2 further comprising:

a) the lower tray having at least one post, wherein the at least one post is configured to aid in placement of the upper tray on the lower tray and to aid in stabilizing the position of the upper tray on the lower tray.

4. The device for filling containers of claim 1 further comprising:

a) the lower tray having at least one post, wherein the at least one post is configured to aid in placement of the upper tray on the lower tray and to aid in stabilizing the position of the upper tray on the lower tray.

5. A method of using a device for filling containers comprising:

a) obtaining a device, food, a tool, a side tray, and a plurality of containers, wherein the device has:

i) a top tray and a bottom tray, wherein the top tray is configured to rest on the bottom tray;

ii) the top tray having a plurality of sleeves, each of the plurality of sleeves having a top opening and a bottom opening;

iii) the bottom tray having a plurality of receiving slots, wherein each receiving slot is able to receive a container;

b) placing one of the plurality of containers in each of the plurality of receiving slots;

c) placing the top tray on top of the bottom tray, wherein each of the plurality of sleeves inserts into one of the plurality of containers;

d) placing food on a top surface of the top tray;

e) using a tool to guide food into the top opening on each of the plurality of sleeves;

f) filling each of the plurality of containers to between 65 and 85 percent capacity, wherein a difference in diameter between each of the plurality of sleeves and each of the plurality of containers facilitates filling each of the plurality of containers to between 65 and 85 percent capacity;

g) using a tool to guide excess food from the top surface of the top tray to a side tray;

h) removing the top tray from the bottom tray; and i) removing the plurality of containers from the receiving slots.

* * * * *